United States Patent [19]

Kumazawa et al.

[11] Patent Number: 4,528,223

[45] Date of Patent: Jul. 9, 1985

[54] COMPOSITE FIBROUS PRODUCT

[75] Inventors: Tetsuo Kumazawa; Hiroaki Doi, both of Ibaraki; Yasuo Miyadera; Atsushi Fujioka, both of Shimodate; Tadashi Nagai, Mooka, all of Japan

[73] Assignees: Hitachi, Ltd.; Hitachi Chemical Co., Ltd.; Fuji Fiber Glass Co., Ltd., all of Tokyo, Japan

[21] Appl. No.: 315,057

[22] Filed: Oct. 26, 1981

[30] Foreign Application Priority Data

Oct. 27, 1980 [JP] Japan ..... 55-149465

[51] Int. Cl.[3] ..... D02G 3/4; D02G 3/18; D02G 3/44; D03D 15/00

[52] U.S. Cl. ..... 428/36; 57/238; 57/240; 57/244; 57/249; 428/229; 428/251; 428/252; 428/253; 428/257; 428/272; 428/273; 428/373; 428/392; 428/395; 428/401; 428/902

[58] Field of Search ..... 57/238, 244, 255, 240, 57/253; 428/377, 392, 394, 401, 229, 251, 252, 253, 257, 272, 273, 395, 36, 902

[56] References Cited

U.S. PATENT DOCUMENTS

| | | | |
|---|---|---|---|
| 3,572,397 | 3/1971 | Austin | 57/255 |
| 4,001,477 | 1/1977 | Economy et al. | 57/255 |
| 4,198,494 | 4/1980 | Burckel | 57/255 |
| 4,246,313 | 1/1981 | Stengle | 428/920 |
| 4,255,817 | 3/1981 | Heim | 428/920 |
| 4,304,811 | 12/1981 | David et al. | 57/238 |

OTHER PUBLICATIONS

Haddod et al., *Textile Research Journal,* (1972), pp. 452–459.

*Chemical Abstracts* 80: 109,715 (1974).

ibid 80: 109,719.

*Primary Examiner*—James C. Cannon

*Attorney, Agent, or Firm*—Antonelli, Terry & Wands

[57] ABSTRACT

Composite fibrous products such as composite cloth, composite strings, composite knitted goods, etc., produced by using combination yarns obtained by twisting one or more aromatic polyamide continuous filament yarns and one or more continuous glass yarns have high rigidity and excellent reinforcing effects.

13 Claims, 1 Drawing Figure

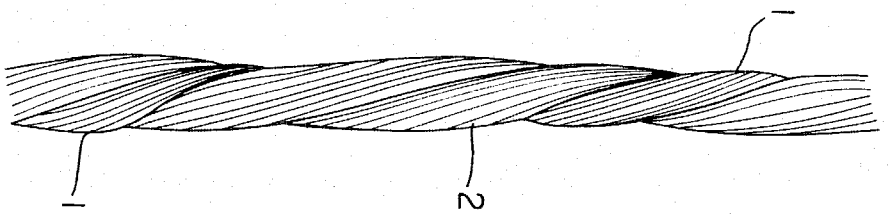
1
2
1

COMPOSITE FIBROUS PRODUCT

This invention relates to composite fibrous products. More particularly, it relates to combination yarn products suitable as a reinforcing material for fiber-reinforced plastics (hereinafter referred to as "FRP") of high quality which are required to have high rigidity.

Various glass fiber products (e.g., glass chopped strand mat, glass cloth, glass roving, glass chopped strand, etc.) are used in a large amount as reinforcing materials for various FRP products, for example, building equipment such as sewage purifiers, baths, water tanks, and the like, industrial materials such as pipes, covers of machinery and tools, and the like, ships, boats, etc.

As reinforcing materials for FRP products such as a concrete shooter which are particularly required to have high impact resistance, these are used composite cloth woven by using combination yarn obtained by mix-twisting thermoplastic organic fiber yarn such as nylon fiber, polyester fiber, or the like together with glass yarn and composite fiber roving produced by winding the aforesaid thermoplastic organic fiber yarn round a bundle of glass fibers in the direction of the glass fibers.

These is disclosed in Japanese Patent Appln Kokai (laid-Open) No. 3487/78 a laminate produced by impregnating composite cloth obtained by mix-twisting glass fiber together with polyester fiber with a resin.

The former glass fiber products often produce much fuzz and are often broken due to poor tensile strength and thus remarkably poor in workability.

The former glass fiber products and composite fibrous products made from glass fiber and thermoplastic organic fiber are excellent in affinity to resins (e.g., unsaturated polyester resins, epoxy resins, silicone resines, etc.) used as a matrix of FRP products and have a great reinforcing effect, however these products have lower elastic modulus than carbon fibers and aromatic polyamide fibers and hence are sometimes unsatisfactory as reinforcing materials for construction materials made from FRP and the like in which rigidity is important.

On the other hand, carbon fiber and aromatic polyamide fiber products are used as reinforcing materials in a part of FRP products such as a golf shaft, a fishing rod, a racket frame and the like which are required to have high elastic modulus, however when carbon fiber and aromatic polyamide fiber are woven into cloth, the resulting cloth is limp and fragile, irregular in weave, and apt to get out of shape.

Moreover, there is another problem in that since carbon fiber and aromatic polyamide fiber products are very expensive, resulting FRP products are also expensive.

Furthermore, these fibers have another problem in that they are inferior to glass fibers in affinity (wetting) to resins used as a matrix for FRP products and hence have less reinforcing effect than that of glass fiber products, so that peeling-off tends to occur on the fibrous product substrate at an interface in FRP products.

There are proposed in Japanese Utility Model Appln Kokoku (Post-Exam Publn) No. 46308/78 FRP products which solve problems caused by glass fiber products and aromatic polyamide fiber products individually. The FRP products disclosed in said publication are tubes for a fishing rod and a golf club in which the inner layer is reinforced with aromatic polyamide fiber and the outer layer with glass fiber, and such FRP products having a two-layer structure or a multi-layer structure provide a problem in that peeling-off tends to take place on the interface between the glass fiber-reinforced portion and the aromatic polyamide fiber-reinforced portion, so that the FRP products cannot be expected to have high strength. Moreover, they have another problem in that they are reinforced with two kinds of fibers different in coefficient of thermal expansion, so that when they undergo heat history, stress is caused on the interface between the portions reinforced by each of two kinds of the fiber products, resulting in formation of fine cracks on the interface.

An object of this invention is to provide a composite fibrous product having a great reinforcing effect and very high rigidity.

Another object of this invention is to provide a composite fibrous product having slight fuzz of glass fiber and greatly improved workability.

In order to solve the problems in conventional techniques, the present inventors paid attention particularly to aromatic polyamide fiber among organic fibers and have studied extensively composite fibrous products comprising aromatic polyamide fiber and glass fiber to find that composite fibrous products such as composite cloth, composite strings, composite sleeves and the like obtained by processing combination yarn made by mix-twisting aromatic polyamide fiber and glass fiber can achieve the purposes mentioned above, whereby this invention has been accomplished.

The attached drawing shows one example of combination yarn used in this invention.

The combination yarn used in the composite fibrous products of this invention is obtained by mix-twisting aromatic polyamide fiber (2) with glass fiber (1) as shown in the attached drawing. More in detail, the combination yarn includes that obtained by twisting an aromatic polyamide filament yarn with a glass yarn; that obtained by twisting an aromatic polyamide filament yarn with a plurality of twisted glass yarns; that obtained by twisting a glass yarn with a plurality of twisted aromatic polyamide filament yarns; that obtained by twisting a plurality of twisted aromatic polyamide filament yarns with a plurality of twisted glass yarns; that obtained by doubling a plurality of further twisted combination yarns mentioned above; that obtained by winding an aromatic polyamide filament yarn around a glass yarn as a core yarn in the direction of the core thread; and that obtained by winding a glass yarn around an aromatic polyamide filament yarn as a core thread in the direction of the core thread.

The employment of these microscopically uniform combined yarns as starting yarn for composite fibrous products is advantageous in that the wearing workability is greatly improved.

For example, in the case of weaving composite cloth by using the above-mentioned combination yarn, glass fiber is less napped than in the case of weaving glass cloth by using glass yarn, and the combined yarn is hardly broken at the time of weaving processing, so that not only the workability is greatly improved, but also defects of composite cloth caused by napping and broken yarn become very few.

The composite fibrous products of this invention processed by using microscopically uniform combination yarn are good in affinity to resins, which is a matrix at the time of molding FRP products, and hence have a great reinforcing effect and give remarkably high rigidity.

Typical examples of the composite fibrous products of this invention include composite cloth, composite strings, composite knitted goods, composite sleeves, and the like. Among the combination yarns used in these composite fibrous products, that having a higher proportion of mix-twisted aromatic polyamide can provide FRP products having higher rigidity but more expensive and slightly lowered in mechanical strength. On the other hand, with an increase of the mix-twisted proportion of glass fiber in the combination yarn, affinity of the combination yarn to resins is improved, and mechanical flexural strength of FRP products is increased, but rigidity (flexural modulus) of FRP products tends to be lowered. Therefore, particularly preferable mix-twisted proportions of the aromatic polyamide fiber and the glass fiber in the combination yarn used in the composite fibrous products of this invention range from 30 to 95% by weight of the aromatic polyamide fiber and from 5 to 70% by weight of the glass fiber.

The aromatic polyamide fiber used in this invention is spun from an aromatic polyamide represented by the formula:

$$(-Ar_1-CONH-)_n,$$
$$(-Ar_1-CONH-Ar_2-NHCO-)_n$$

wherein $Ar_1$ and $Ar_2$ are the same or different and represent each aromatic residue and n is an integer of 50 or more. Examples of the aromatic residues are

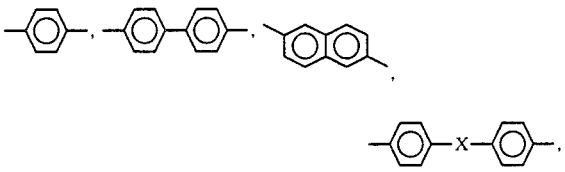

or the like (X is a divalent radical or an atom selected brom O, $CH_2$, S, $SO_2$, and CO). These aromatic polyamides may be used alone or as a mixture thereof. In addition, the aromatic polyamide may also contain

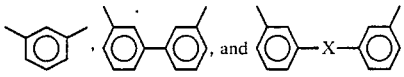

in amounts of up to 30% by mole for improving the solubility of the polymer. These aromatic residues may further be substituted by inactive radical such as halogen, alkyl, nitro. The especially preferred aromatic polyamide fibers are those spum from aromatic polyamides selected from poly(p-phenylene terephthalamide), poly(p-benzamide), and copolymer of monomer units thereof. Kevlar 49 of E. I. du Pont de Nemours and Company can be used as the aromatic polyamide fiber. Processes for producing these aromatic polyamide fibers are disclosed, for example, in U.S. Pat. Nos. 3,671,542 and 3,888,965.

Representative examples of the glass fiber for giving the combination yarn used in the composite fibrous products of this invention include E-glass fiber, C-glass fiber, A-glass fiber, and the like.

These glass fibers are subjected to a sizing treatment at the time of spinning, and then used as raw fibers for the combination yarn.

Sizing agents for glass fibers usually include starch sizing agents and plastic (e.g. epoxy resin, polyester resin) sizing agents. Glass fiber treated with a starch sizing agent is usually subjected to twist processing to be finished into glass yarn. The glass yarn is used for weaving various glass cloth different in weaving density. When the thus obtained glass cloth is used as a reinforcing material, the starch sizing agent having no affinity to the matrix adhered to the surface of the glass fiber is removed by heating or washing with water, after which the glass cloth is treated with a surface-treating agent (any of various silane coupling agents when used as a resin-reinforcing agent) to obtain a glass fiber product for FRP. On the other hand, plastics series sizing agents are those which are generally applied to glass fibers for FRP, and they are good in affinity to the resins, therefore the glass fiber products obtained need not be treated again as in the case of starch sizing agents.

The sizing agent for the glass fiber used in the composite fibrous products of this invention may be either a starch one or plastics one, though the employment of plastics sizing agents is advantageous in that since they are good in affinity to the resin, the re-treatment step can be omitted, so that the cost of the composite fibrous products can greatly be reduced, as compared with the case where a starch sizing agent is used.

In the composite fibrous products of this invention, the larger the number of twist becomes, the more the ability to be impregnated with the resin of the composite fibrous products tends to be deteriorated, and the smaller the number of twist becomes, the more difficult the production of microscopically uniform composite fibrous products becomes. Therefore, the particularly preferable number of twist of the combination yarn ranges from 1 to 15 (turns/25 mm).

The thicker the combination yarn becomes, the more coarse the finished composite fibrous product becomes, and hence there are obtained FRP products which are not microscopically uniform. The thinner the combination yarn becomes, the more the efficiency of production of the composite fibrous products is decreased. Accordingly, the thickness of the combination yarn used in this invention ranges particularly preferably from 10 to 150 tex (g/1,000 m).

The composite fibrous products of this invention, i.e., the composite cloth, composite strings, composite knitted goods and composite sleeve can more easily be produced from the combination yarn than from glass yarns by supplying the combination yarn to a weaving machine for glass fibers which has conventionally been known as a producing machine of glass fiber products.

For example, composite cloth can easily be produced by various textile weaves (plain weave, twill weave, satin weave, imitation gauze weave, leno weave, fancy weave, etc.,) using prescribed combination yarn and a weaving machine for glass fibers.

Composite knitted goods can also easily be produced by using, as in the case of the composite cloth, a knitting machine for glass fibers which has conventionally been used as a machine for knitting glass fibers.

A method for producing a FRP product by using the composite fibrous product of this invention include molding methods such as a hand lay-up method, a press method, a prepreg method, a filament-winding method, a continuous machine method and the like which have conventionally been known as methods for producing FRP products in which a glass fiber product is used. FRP products can easily be produced by using these molding methods.

This invention is further explained more in detail by way of the following Examples and Comparative Examples.

EXAMPLE 1

Plain woven composite cloth having each density of fabric listed in Table 1 was prepared by means of a weaving machine for glass fibers by using as warp and weft a combination yarn obtained by mix-twisting glass fiber prescribed by Japanese Industrial Standard (JIS) with Kevlar yarn (registered trade mark, E. I. du Pont de Nemours & Co.) as listed in Table 1. The weaving workabilities in the case are shown in Table 1.

Sample Nos. 1 and 2 in Table 1 show composite cloths woven by using glass fiber treated with a starch sizing agent, followed by washing with water to remove the sizing agent and subjected to surface treatment (adhered amount = 0.2% by weight) with epoxysilane, and then dried, whereby epoxysilane-treated composite cloths could be obtained. The thus prepared epoxysilane-treated composite cloths were coated with an unsaturated polyester of isophthalic acid type to produce prepregs. Each of the prepregs was cut to a size of 1 × 1 m, and the resulting pieces were piled up in the number described in Table 1, fed into a mold for a FRP plate, and then molded into a FRP plate under the press conditions of 80 Kgf/cm$^2$ at a mold temperature of 160° C. and a pressing time of 10 minutes. Test pieces obtained by cutting the thus prepared FRP plate to a size of 100 × 100 mm were immersed in a soldering bath at 300° C. for 15 seconds, after which the number of micro-delamination, flexural strength and flexural modulus were measured. The results are shown in Table 1.

The results of evaluation of the weaving workability of, as comparative examples, glass cloth woven by using glass yarn alone and Kevlar cloth woven by using Kevlar 49 alone are shown in Table 1. Treated glass cloth obtained by washing the glass cloth with water and then subjecting it to epoxysilane treatment (adhered amount = 0.2% by weight) and untreated Kevlar cloth were subjected to coating with the resin and press molding under exactly the same conditions as mentioned above, and each of the thus obtained FRP plates was cut to a size of 100 × 100 mm. The thus obtained FRP test pieces were immersed in a soldering bath for 15 seconds, after which the number of micro-delamination, the flexural strength and the flexural modulus were measured. The results are shown in Table 1. It can be seen from Table 1 that the workabilities of the FRP plates reinforced with the respective composite cloths of Sample Nos. 1 and 2 in Example 1 of this invention are superior to that of the glass cloth of Sample No. 1 in Comparative Example.

It can be also seen that the FRP plates reinforced with the respective composite cloths of Sample Nos. 1 and 2 in Example 1 of this invention show a much smaller number of slight peeling-off after undergoing the heat history in the soldering bath and higher bending strength than the FRP plate reinforced with the Kevlar cloth of Sample No. 2 in Comparative Example.

This is because the composite cloth woven by the combination yarn obtained by mix-twisting the glass yarn with Kevlar 49 is microscopically uniform and excellent in affinity to the resin.

It can be also seen that the FRP plates reinforced with the respective composite cloths of Sample Nos. 1 and 2 in Example of this invention have higher flexural modulus and higher rigidity than the FRP plate reinforced with the glass cloth of Sample No. 1 in Comparative Example.

EXAMPLE 2

Composite roving obtained by doubling 51 composite yarns of Sample No. 2 in Example 1 to a bundle of 2,310 tex and then winding it in cylindrical form was impregnated with an epoxy resin, and by use of the composite roving, a FRP pipe having an inside diameter of 6 mm and an outside diameter of 8 mm was molded by a filament winding method. The bending strength of the FRP pipe was as high as 42.8 Kgf/mm$^2$ measured according to JIS K3911. Similarly, a FRP pipe having an inside diameter of 6 mm and an outside diameter of 8 mm was molded by winding a roving obtained by doubling Kevlar fibers of 1,560 tex to a thickness of 1 mm to form an inner layer portion, and winding glass roving of 2,310 tex to a thickness of 1 mm to form an outer layer portion. Its flexural strength was 29.3 Kgf/mm$^2$, which was much lower than that of the FRP pipe obtained by using the composite roving of this invention. This is because peeling-off tends to occur on the interface between the inner layer portion wound by the Kevlar roving and the outer layer portion wound by the glass roving.

On the other hand, the reason why the flexural strength of the FRP pipe obtained by using the composite roving of this invention was high is that said composite roving is microscopically uniform and excellent in affinity to the resin, so that peeling-off does not occur.

TABLE 1

| | Textile weave and characteristics of FRP plates | | | | |
|---|---|---|---|---|---|
| | Example 1 | | | Comparative Example | |
| | Sample No. | | | | |
| Items | 1 | 2 | 3 | 1 | 2 |
| Yarn used | Combination yarn of 66 tex obtained by twisting 3.8 times with left hand twist (S) a glass yarn (ECE225-1/04Z) sized with a starch sizing agent and two Kevlar 49 with right hand twist (Z) of 4 times. | Combination yarn of 45 tex obtained by twisting 3.8 times with left hand twist a glass yarn (ECE225-1/04Z) sized with a starch sizing agent and a Kevlar 49 with right hand twist of | Combination yarn of 45 tex obtained by twisting 3.8 times with left hand twist a glass yarn (ECE225-1/04Z) sized with a plastic sizing agent and a Kevlar 49 with right a hand twist of 4 | Glass thread (ECG75-1/01Z) | Kevlar 49 |

TABLE 1-continued

| Items | | Textile weave and characteristics of FRP plates | | | | |
|---|---|---|---|---|---|---|
| | | Example 1 | | | Comparative Example | |
| | | Sample No. | | | | |
| | | 1 | 2 | 3 | 1 | 2 |
| Density of fabric of the warp and weft (number/25 mm, warp × weft) | | 35 × 35 | 4 times 37 × 37 | times. 37 × 37 | 42 × 32 | 33× 34 |
| Thickness of cloth (mm/strip) | | 0.20 | 0.16 | 0.16 | 0.18 | 0.104 |
| Weaving workability of cloth | | Scarcely napped. Very good | Scarcely napped, Very good | Scarcely napped, Very good | Napped. Slightly bad | Very good |
| Number of piled prepregs | | 7 | 9 | 9 | 8 | 14 |
| Characteristics of FPR plate | Number of micro-delamination after immersing a 100 × 100 mm test piece in a soldering bath at 300° C. for 15 seconds | 3 | 3 | 2 | 2 | 21 |
| | Flexural strength (Kgf/mm$^2$) | 40.5 | 43.3 | 42.1 | 46.2 | 30.6 |
| | Flexural modulus (Kgf/mm$^2$) | 3090 | 3010 | 3100 | 1630 | 3280 |

Note
[1]All the numbers of twist are values per 25 mm.
[2]S and Z indicate the directions of twist.

What is claimed is:

1. A composite fibrous product having a great reinforcing effect and high rigidity comprising combination yarn obtained by mix-twisting aromatic polyamide continuous filament yarn and continuous glass yarn; said aromatic polyamide being selected from the group consisting of poly(p-phenylene terephthalamide), poly(p-benzamide) and copolymers of monomer units thereof.

2. A composite fibrous product according to claim 1, wherein said composite fibrous product is used for reinforcing plastics; the resulting fiber-reinforced plastics having increased flexural modulus and increased rigidity.

3. A composite fibrous product according to claim 1, wherein the combination yarn is obtained by a mix-twisting 30 to 95% by weight of the aromatic polyamide continuous filament yarn and 5 to 70% by weight of the continuous glass yarn.

4. A composite fibrous product according to claim 2, wherein the combination yarn used for reinforcing plastics is obtained by mix-twisting 30 to 95% by weight of aromatic polyamide continuous filament yarn and 5 to 70% by weight of continuous glass yarn.

5. A composite fibrous product according to claim 1, 3 or 4, wherein the combination yarn has the number of twist of 1 to 15 turns/25 mm.

6. A composite fibrous product according to claim 1, 3 or 4, wherein the combination yarn has a thickness of 10 to 150 tex (g/1,000 m).

7. A composite fibrous product according to claim 1, 3 or 4, wherein the aromatic polyamide continuous filament yarn is poly(p-phenyleneterephthalamide) continuous filament yarn.

8. A composite fibrous product according to claim 1, 3 or 4, wherein the aromatic polyamide continuous filament yarn is poly(p-benzamide) continuous filament yarn.

9. A composite fibrous product according to claim 1, wherein said composite fibrous product is composite cloth.

10. A composite fibrous product according to claim 1, 3 or 4, wherein the continuous glass yarn is sized with a sizing agent having affinity to an impregnating resin.

11. A composite fibrous product according to claim 1, wherein said composite fibrous product is a composite string.

12. A composite fibrous product according to claim 1, wherein said composite fibrous product is a composited knitted good.

13. A composite fibrous product according to claim 1, wherein said composite fibrous product is a composite sleeve.

* * * * *